US005226478A

United States Patent [19]

Henderson, Jr. et al.

[11] Patent Number: 5,226,478

[45] Date of Patent: Jul. 13, 1993

[54] CEMENT PORT CLOSURE SLEEVE FOR A SUBSEA WELL

[75] Inventors: Herman O. Henderson, Jr., Houston, Tex.; Philippe C. Nobileau, Paris, France

[73] Assignee: ABB Vetco Gray Inc., Houston, Tex.

[21] Appl. No.: 857,029

[22] Filed: Mar. 24, 1992

[51] Int. Cl.[5] ..... E21B 33/04

[52] U.S. Cl. ..... 166/285; 166/87; 166/89; 166/186; 166/382

[58] Field of Search ..... 166/87-89, 166/186, 373, 382, 348, 317

[56] References Cited

U.S. PATENT DOCUMENTS

| | | | |
|---|---|---|---|
| 2,118,094 | 5/1938 | McDonough et al. | 166/89 |
| 2,157,496 | 5/1939 | Penick et al. | 166/89 X |
| 3,087,547 | 4/1963 | Raulins et al. | 166/89 |
| 3,548,934 | 12/1970 | Hutchison | 166/89 X |
| 3,625,283 | 12/1971 | Ahlstone | 166/87 |
| 3,638,725 | 2/1972 | Ahlstone | 166/330 |
| 3,827,488 | 8/1974 | Piazza et al. | 166/87 |
| 4,449,583 | 5/1984 | Lawson | 166/87 X |
| 4,736,799 | 4/1988 | Ahlstone | 166/348 |
| 4,928,769 | 5/1990 | Milberger et al. | 166/382 |
| 5,092,401 | 2/1992 | Heynen | 166/89 |

*Primary Examiner*—Ramon S. Britts
*Assistant Examiner*—Frank S. Tsay
*Attorney, Agent, or Firm*—James E. Bradley

[57] ABSTRACT

A subsea well assembly has a cement port closure sleeve which opens and closes a cement port in an outer wellhead housing. The outer wellhead housing secures to conductor pipe. An inner wellhead housing is lowered into the outer wellhead housing before the well is drilled past the conductor pipe, and without having any casing secured to the inner wellhead housing. The sleeve opens and closes an inner return port that extends through the inner wellhead housing and which registers with the outer return port once the inner wellhead housing is in place. Drilling through the inner wellhead housing takes place with the sleeve closed. Subsequently, when casing is run, the casing hanger will engage the sleeve and move it to an open position. This allows cement returns to flow out the inner and outer return ports.

19 Claims, 3 Drawing Sheets

CEMENT PORT CLOSURE SLEEVE FOR A SUBSEA WELL

BACKGROUND OF THE INVENTION

1. Field of the Invention

This invention relates in general to subsea well assemblies, and in particular to a method and apparatus for installing a first string of casing in the well so as to utilize pressure control during the drilling for the first string of casing.

2. Description of the Prior Art

In subsea well drilling of the type concerned herein, the operator will first drill a large diameter hole to a selected depth. The operator then secures a string of conductor pipe to an outer wellhead housing and lowers the assembly into the well. The operator will pump cement down the conductor pipe, which flows back up the annulus to cement the conductor pipe in the well.

Then, the operator will drill the well to a second depth. Often this is handled by drilling a pilot hole. A riser will extend from the drilling vessel into the outer wellhead housing during drilling of the pilot hole for drilling fluid circulation. A diverter at the drilling vessel will divert drilling fluid returns in the event of high pressure being encountered.

Then the operator will remove the riser and run a larger diameter drill bit through the outer wellhead housing and conductor pipe to ream out the pilot hole. Normally, cuttings and drilling fluid will flow out open cement ports provided in the outer wellhead housing, and will not be returned back to the drilling vessel. Also, normally, there will be no means for controlling any high pressure that might occur during drilling of this second portion of the well.

After the second depth has been drilled and reamed, the operator will secure a string of casing to an inner wellhead housing and lower the assembly into the well. The inner wellhead housing seats within the outer wellhead housing. While running the inner wellhead housing and casing, no pressure control equipment is available as the riser will not be connected. The outer wellhead housing has a radially extending return flow passage extending through its sidewall. The operator pumps cement down the string of casing with the cement flowing back up the annulus between the casing and the conductor pipe. Cement returns flow up and out the cement return ports of the outer wellhead housing.

In some offshore drilling, a subsea template will be used for drilling a number of wells. The drilling rig may be located on a vessel which remains at the site for production, such as a tension leg platform. In such a case, the operator will not want to deposit a large amount of cuttings on the subsea template. In the prior art, a substantial amount of cuttings would flow out, the outer wellhead housing cement return ports during reaming of the second drilling phase of the well. Also, because of a remote possibility of a blowout, the operator may wish to have pressure control during all phases of drilling, including reaming of the pilot hole and running the first string of casing.

SUMMARY OF THE INVENTION

In this invention, the inner wellhead housing will be lowered into and installed in the outer wellhead housing before it is connected to the first string of casing. The inner wellhead housing will be lowered in place before the well has been drilled to the second depth. The inner wellhead housing has inner return ports which communicate with the outer return ports in the outer wellhead housing. A closure means closes the inner return ports. This allows the operator to connect pressure equipment and a riser to the inner wellhead housing for controlling pressure during drilling of the well to the second depth.

After the well has been drilled and reamed to the second depth, the operator then lowers the first string of casing on a casing hanger through the riser. Pressure control equipment remains in place. The closure means is opened to open the inner return ports. This allows the operator to flow cement from around the first string of casing out the outer return ports in the outer wellhead housing.

Two embodiments are shown, with both embodiments employing a closure sleeve for closing and opening the inner return port. The casing hanger in both embodiments has a lower extension that latches into the closure sleeve as the casing hanger is being lowered into the inner housing. Downward movement of the casing hanger pushes the closure sleeve downward to open the inner return ports.

In one embodiment, the closure sleeve has an axial passage extending through it that communicates with the radially extending inner and outer return ports. In that embodiment, a lower stop shoulder provides a limit for the downward travel. The casing hanger weight is supported on the closure sleeve and the stop shoulder.

In the other embodiment, the sleeve is a solid member, not having any passages formed in it. In the second embodiment, the weight of the casing is supported on the conventional load shoulder formed in the bore of the inner wellhead housing.

DETAILED DESCRIPTION OF THE INVENTION

Figure 1:
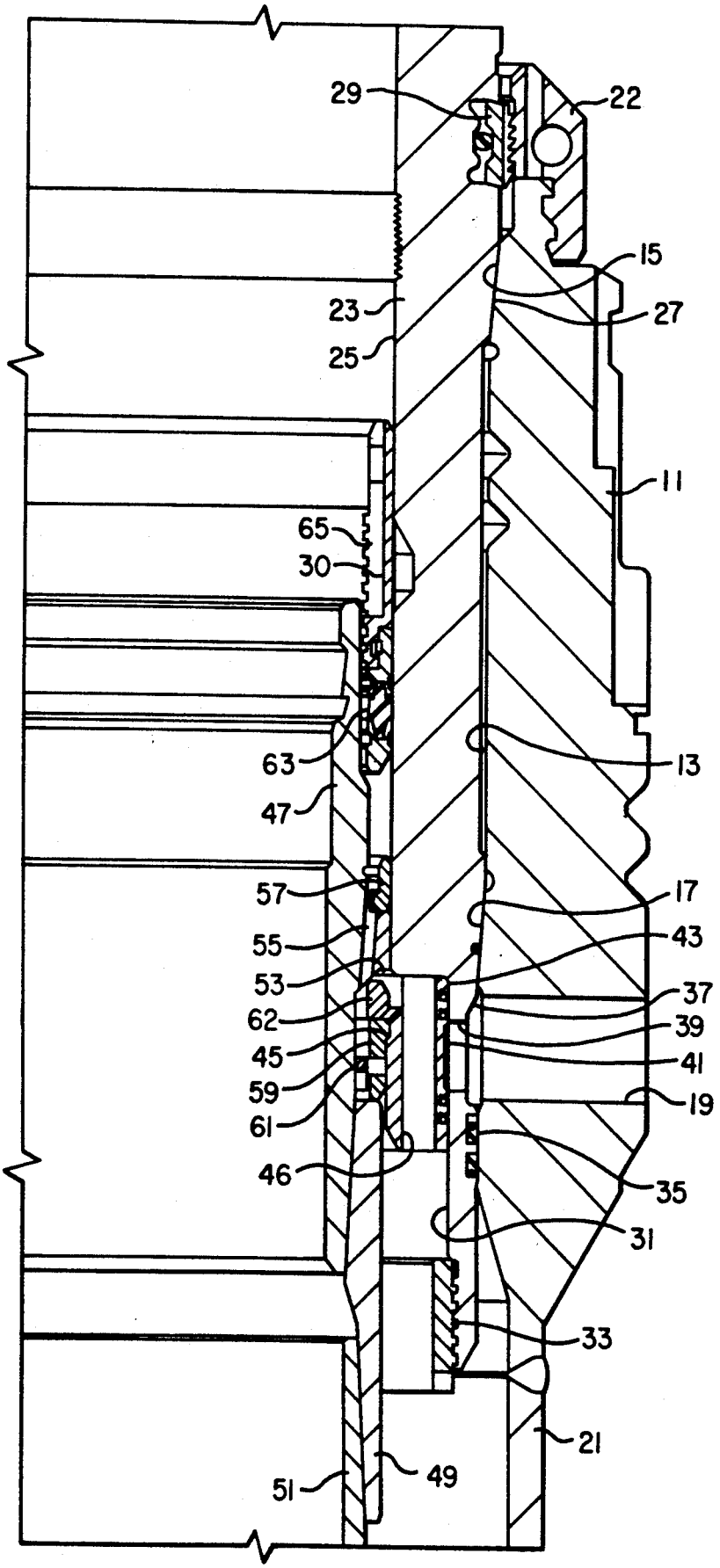
FIG. 1 is a partial quarter sectional view illustrating a subsea well assembly having a first embodiment of an inner wellhead housing and closure sleeve constructed in accordance with this invention.

Referring to FIG. 1, outer wellhead housing 11 is conventional. Outer wellhead housing 11 has an axial bore 13 extending through it that will be oriented vertically. Outer wellhead housing 11 locates at a subsea floor. Bore 13 has two axially spaced apart seating tapers 15, 17. A plurality (only one shown) of outer return ports 19 extend radially through outer wellhead housing 11 below the lower seating taper 17. A string of conductor pipe 21 secures to the lower end of outer wellhead housing 11. Conductor pipe 21 extends into the well to a selected initial depth and will be cemented in place. A conventional latch 22 mounts to the upper end of outer wellhead housing 11.

An inner wellhead housing 23 will be lowered by an operator into outer wellhead housing 11 after conductor pipe 21 has been cemented in place. Inner wellhead housing 23 has an axial bore 25 and spaced apart tapered profiles 27 on the exterior that wedge tightly into the seating tapers 15, 17. A latch 29 ratchets into and latches in latch 22.

Inner wellhead housing 23 has a load shoulder 30 formed in bore 25. Load shoulder 30 is an annular recess. Inner wellhead housing 23 has an annular counterbore or recess 31 formed on its lower end. Recess 31 is of larger diameter than the upper portion of bore/25. A stop ring 33 secures by threads to the lower end of inner wellhead housing 23. Stop ring 33 extends radially inward from the wall of recess 31, providing an upward facing shoulder.

Seals 35 locate on the exterior of inner wellhead housing 23 for sealing the lower end of inner wellhead housing 23 to outer wellhead housing bore 13. Seals 35 locate below outer return ports 19. An annular exterior recess 37 extends around the exterior of inner wellhead housing 23 immediately below seals 35. Recess 31 is positioned to radially align with outer return ports 19.

A plurality of inner return ports 39 (only one shown) extend radially through inner wellhead housing 23. Each inner return port 39 has an outlet at external recess 37 and an inlet at bore recess 31. Inner return ports 39 will thus communicate the bore recess 31 with the outer return ports 19.

A closure sleeve 41 is carried in the bore recess 31. Closure sleeve 41 will move from the closed position shown in FIG. 1 to an open position shown in FIG. 2. A shear pin (not shown) initially retains sleeve 41 in the upper closed position. The exterior of sleeve 41 will block the inlet of inner return ports 39 when in the closed position. Seals 43 on the exterior of sleeve 41 provides sealing around the inner return ports 39.

Sleeve 41 has a latch profile 45 in its interior. Latch profile 45 comprises grooves defining an upward facing shoulder. The latch profile 45 has an inner diameter that is substantially the same as the inner diameter of bore 25 immediately above recess 31. The radial thickness of sleeve 41 is substantially the same as the radial distance between the wall of recess 31 and the wall of bore 25 immediately above recess 31.

Sleeve 41 has a plurality of axially extending passages 46 (only one shown). Each passage 46 extends from the lower end to the upper end of sleeve 41. Passages 46 communicate with the interior of conductor pipe 21 through bore recess 31 and stop ring 33. When in the open position, fluid is free to flow up through passages 46 and through the inner return ports 39 and outer return ports 19.

During the second phase of drilling, only the inner wellhead housing 23 will be located in the outer wellhead housing 11, and the sleeve 41 will be closed. A riser (not shown) with pressure control equipment will be secured to the upper end of inner wellhead housing 23 and extend upward to the drilling vessel. Sleeve 41 seals outer return ports 19, causing drilling fluid to flow up the riser in a closed circulation system.

After completing the drilling to the desired second depth, the operator lowers a casing hanger 47 into inner wellhead housing 23. Casing hanger 47 is basically a conventional casing hanger, but is used in a different manner than in the prior art. Casing hanger 47 has a lower extension 49 secured to it by threads. A string of casing 51 secures to the lower extension 49. Casing 51, typically 20 inches in diameter, would normally be secured to the lower end of inner wellhead housing 23 in the prior art, not to a casing hanger. Casing hanger 47 has a load shoulder 53 on its exterior that faces downward. In the embodiment shown, passages 55 extend through load shoulder 53. A retainer ring 57 of conventional design locates on the upper side of casing hanger load shoulder 53. Retainer ring 57 is a split ring, which is expanded to an outer position during the setting procedures illustrated in FIG. 2.

A latch ring 59 mounts to the exterior of casing hanger 47 at the upper end of lower extension 49. Latch ring 59 is held against rotation by a key 61. Latch ring 59 has an outer profile that has a downward facing shoulder for mating with latch profile 45. Latch ring 59 is split, resilient and biased to an outer position. A split, expansible load ring 62 locates in contact with the upper end of latch ring 59. The upper end of load ring 62 engages the downward facing load shoulder 53.

A conventional seal 63 is carried by a threaded ring 65 that engages threads on the upper end of casing hanger 47. After cementing casing 51, a running tool (not shown) will rotate threaded ring 65 to move seal 63 from the running position shown in FIG. 1 to the set position shown in FIG. 2.

Figure 2:
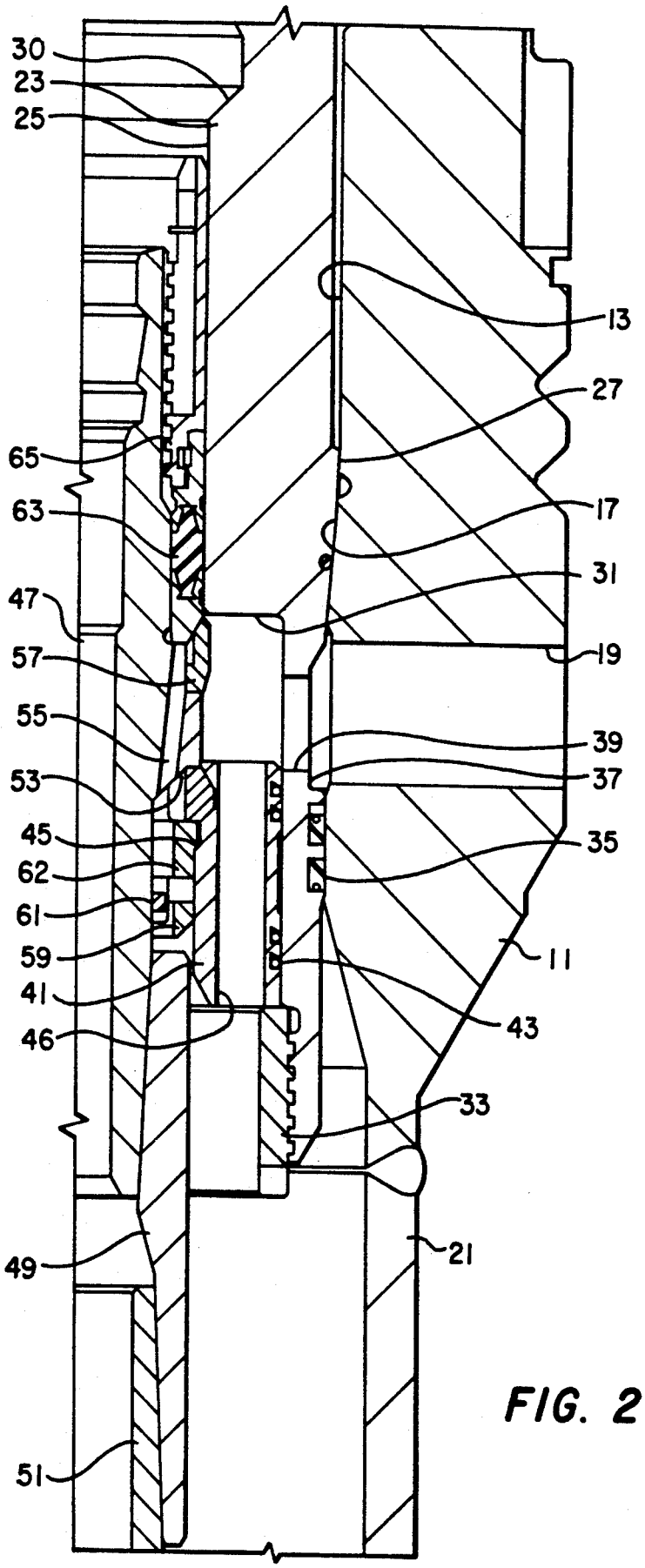
FIG. 2 is an enlarged partial quarter sectional view of the subsea well assembly of FIG. 1, showing the closure sleeve moved to an open position.

In the operation of the embodiment of FIGS. 1 and 2, the well will be drilled to an initial depth. Then the conductor pipe 21 will be lowered into the well, with the outer wellhead housing 11 locating at the surface. The conductor pipe 21 is cemented in a conventional manner.

Then, the operator lowers the inner wellhead housing 23 into the outer wellhead housing 11. There will be no casing attached to the inner wellhead housing 23. Sleeve 41 will be in the upper closed position as shown in FIG. 1. A seat protector (not shown) will be located in bore 25. The seat protector is a tubular sleeve that extends over load shoulder 30 and down past sleeve 41. The operator will connect a riser (not shown) to the inner wellhead housing 23, the riser extending upward to the drilling platform on the drilling vessel. The riser will have pressure control equipment, such as a blowout preventer.

The operator then lowers a drill bit through the riser, through the inner wellhead housing 23 and begins drilling a pilot hole below the conductor pipe 21 while drilling, drilling fluid will circulate back up the inner wellhead housing 23 and riser to the surface vessel. After drilling with the drill bit, a reamer (not shown) will be lowered through the riser and inner wellhead housing 23 to ream the well out to a greater diameter. The reamer will be of a type that will contract in diameter to pass through the inner wellhead housing 23 and then expand in diameter upon reaching open hole.

After the well has been drilled to the second depth, the operator will lower a running tool to retrieve the seat protector. The operator then lowers a string of casing 51 through the riser and into the well. Casing hanger 47 will be secured to the upper end of casing 51. The latch ring 59 will be located on the exterior of casing hanger 47. The pressure control equipment will remain in place. The inner return ports 39 remain closed as the casing 51 is being lowered into the well.

As the casing hanger 47 passes downward in the inner wellhead housing 23, the latch ring 59 will spring outward and engage the profile of sleeve 41. Continued downward movement of the casing hanger 47 will push the sleeve 41 downward to the open position shown in FIG. 2, wherein sleeve 41 rests on stop ring 33. The load ring 62 will be pushed outward by the downward facing load shoulder 53. The weight of the casing transmits through casing hanger 47, load shoulder 53, load ring 62, sleeve 41 and stop ring 33 to the inner wellhead housing 23. The load transmits through the seating tapers 15, 17 to the outer wellhead housing 11.

Then, the operator will pump cement down the string of casing 51 to return up the annulus surrounding casing 51. The cement returns flow up through the stop ring 33, bore recess 31, axial passages 46, and out the inner return ports 39 and outer return ports 19. Once cementing has been completed, the operator uses the casing hanger running tool to rotate the threaded ring 65. Threaded ring 65 moves downward, deforming seal 63. Seal 63 will push retainer ring 57 outward. Retainer ring 57 prevents any upward movement of casing hanger 47 as retainer ring 57 will be located below a portion of the shoulder that separates the bore recess 31 from the bore 25.

Further drilling will then take place to a greater depth. Additional strings of casing will be supported on other casing hangers which will land above the casing hanger 47. The casing hanger for the next string will land on load shoulder 30 in bore 25 of inner wellhead housing 23.

Figure 3:
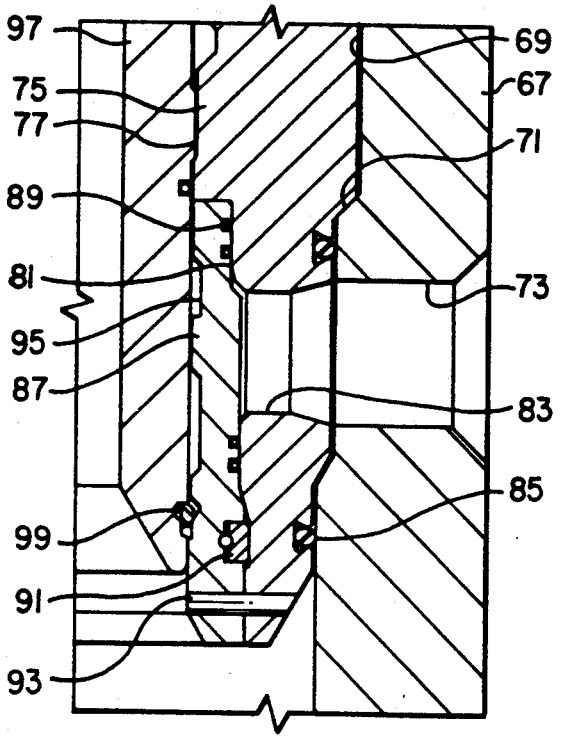
FIG. 3 is a partial quarter sectional view of a second embodiment of a subsea well assembly constructed in accordance with this invention.
Figure 4:
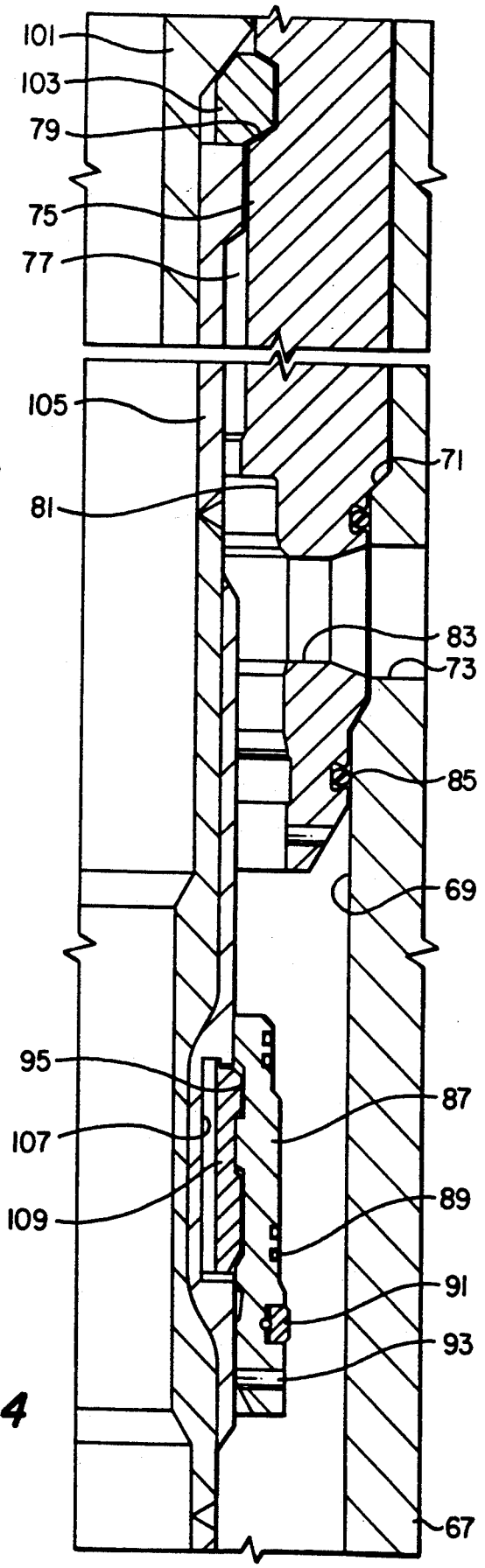
FIG. 4 is a partial quarter sectional view of the subsea well assembly of FIG. 3, showing the closure sleeve in an open position.

In the embodiment of FIGS. 3 and 4, outer wellhead housing 67 may be the same as the wellhead housing 11. It is shown to be another conventional type, having a bore 69 with a landing shoulder 71, rather than seating tapers 15, 17. Outer return ports 73 (only one shown) extend radially through outer wellhead housing 67.

Inner wellhead housing 75 lowers into outer wellhead housing 67, landing on landing shoulder 71. Inner wellhead housing 75 has a bore 77 and a landing shoulder 79 (FIG. 4). An annular recess 81 locates in the lower portion of bore 77. A plurality of inner return ports 83 (only one shown) extend radially through the inner wellhead housing 75 in the recess 81. Seals 85 seal the inner wellhead housing 75 to the outer wellhead housing 67 below inner return ports 83.

A sleeve 87 is carried axially in recess 81. Sleeve 87 has seals 89 on its exterior for sealing around inner return ports 83. A detent 91 will retain sleeve 87 in an upper position. Also, preferably, shear pins 93 will secure sleeve 87 in the upper position shown in FIG. 3. Sleeve 87 has a latch profile 95 on its inner diameter that includes upward facing shoulders.

FIG. 3 shows a seat protector 97 located in bore 77 of inner wellhead housing 75. Seat protector 97 is a tubular sleeve that extends down over a portion of bore 77 and over latch profile 95. A shear ring 99, preferably an elastomeric "D" shaped ring, will releasably hold seat protector 97 in position.

Referring to FIG. 4, a conventional casing hanger 101 will be employed after the well has been drilled and reamed to a second depth. Casing hanger 101 has a load ring 103 that will expand out into engagement with landing shoulder 79. A lower extension 105 extends downward from casing hanger 101. Lower extension 105 has a recess that carries a latch ring 109. Latch ring 109 is a split ring that has a profile on its exterior for engaging latch profile 95 of sleeve 87. A seal (not shown) will seal the exterior of casing hanger 101 to the bore of the inner wellhead housing 75.

In the operation of the embodiments of FIGS. 3 and 4, the outer wellhead housing 67 will be installed in a conventional manner. Subsequently, inner wellhead housing 75 will be lowered into and landed in outer wellhead housing 67. There will be no casing secured to inner wellhead housing 75 at this time. Seat protector 97 will be in place. A riser (not shown) will extend, from inner wellhead housing 75 to the drilling vessel. The riser will have pressure control equipment.

The operator will lower a drill bit on a string of drill pipe to the seat protector 97 and drill a pilot hole below the conductor pipe to a second depth. Cuttings and drilling fluid will flow back up through the seat protector 97 to the vessel. A reamer will be employed to ream the well to a desired diameter Once completed, the operator will lower a tool to retrieve seat protector 97.

The operator will then run a string of casing (not shown) through the riser into the well, the casing being secured to the lower extension 105 (FIG. 4) of casing hanger 101. As the lower extension 105 passes the sleeve 87, latch ring 109 will snap into engagement with the latch profile 95. The weight of the casing will cause the shear pins 93 to shear. The detent 91 will also release. The sleeve 87 will move completely below the lower end of inner wellhead housing 75 as shown in FIG. 4. The load ring 103 will snap into engagement with the load shoulder 79 in inner wellhead housing 75. The weight of the string of casing will be supported on load shoulder 79.

The operator then will cement the casing. Cement returns will flow up around the casing and up and out the inner return ports 83 and outer return ports 73. Once the cementing has been completed, a conventional casing hanger seal (not shown) will be employed to seal an annular space between casing hanger 101 and the bore 77 of inner wellhead housing 75.

Further drilling will then take place to a greater depth. The additional strings of casing will be supported on other casing hangers which will land above the casing hanger 101. If at any time, the operator needs to pull up the first string of casing, the detent 91 will relatch the sleeve 87 in the closed position.

The invention has significant advantages. Running the inner wellhead housing without casing enables pressure control equipment to be utilized during drilling to the second depth and during running of the first string of casing. The riser provides a closed circulation system for cuttings to return to the vessel during reaming of the well. Opening the sleeve with the lowering of the casing hanger enables the outer wellhead housing return ports to be used for cement returns.

While the invention has been shown in only two of its forms, it should be apparent to those skilled in the art that it is not so limited, but is susceptible to various changes without departing from the scope of the invention.

We claim:

1. In a subsea well assembly having a tubular outer wellhead housing secured to a string of conductor pipe extending into the well to a first depth, the outer wellhead housing having an outer return port extending therethrough, an improved means for supporting a string of casing which extends to a second depth, comprising in combination:

an inner wellhead housing which lands sealingly within the outer wellhead housing prior to drilling the well past the first depth;

an inner return port extending through the inner wellhead housing in fluid communication with the outer return port;

closure means for closing the inner return port to cause drilling fluid returns to flow up through the inner wellhead housing to a drilling platform while drilling through the inner wellhead housing to the second depth;

casing hanger means secured to an upper end of the string of casing for landing within the inner wellhead housing after the well has been drilled to the second depth; and the closure means opening the inner return port after the well has been drilled to the second depth, to allow cement returns to flow out the inner and outer return ports while cementing the string of casing in the well.

2. The subsea well assembly according to claim 1 wherein the closure means comprises a sleeve that is movable from a closed position to an open position, closing and opening the inner return port.

3. The subsea well assembly according to claim wherein the closure means comprises:

a sleeve mounted to the inner wellhead housing and being axially movable from a closed position to an open position, closing and opening the inner return port; and engagement means on the sleeve and on the casing hanger means for moving the sleeve to the open position as the casing hanger means lowers into the inner wellhead housing.

4. In a subsea well assembly having a tubular outer wellhead housing secured to a string of conductor pipe extending into the well to a first depth, the outer wellhead housing having an outer return port extending therethrough, the improvement comprising in combination:

an inner wellhead housing which lands sealingly within the outer wellhead housing prior to the well being drilled past the first depth;

an inner return port extending through the inner wellhead housing in fluid communication with the outer return port;

a sleeve mounted to the inner wellhead housing and being axially movable from a closed position to an open position, closing and opening the inner return port, the sleeve when in the closed position allowing the well to be drilled to a second depth with drilling fluid returns flowing up the inner wellhead housing to a drilling platform;

a casing hanger secured to a string of casing, the casing hanger being lowered into and suspended in the inner wellhead housing after the well has been drilled to the second depth; and engagement means on the sleeve and on the casing hanger for moving the sleeve to the open position as the casing hanger is lowered into the inner wellhead housing, to allow cement returns to flow out the inner and outer return ports while cementing the string of casing in the well.

5. The subsea well assembly according to claim 4 wherein the inner and outer return ports extend radially relative to a longitudinal axis of the outer wellhead housing.

6. The subsea well assembly according to claim 4 wherein the engagement means comprises:

a latching profile formed on an inner side of the sleeve; and a latch ring mounted to a lower section of the casing hanger, the latch ring being resilient and biased outward for latching into the latching profile when the latch ring is moved downward adjacent to the sleeve, causing the sleeve to move downward with the casing hanger.

7. The subsea well assembly according to claim 4 wherein the inner and outer return ports extend radially relative to a longitudinal axis of the outer wellhead housing, with the inner return port having a radially inward inlet and a radially outward outlet, wherein the sleeve is carried at the inlet of the return port, and wherein the subsea well assembly further comprises:

seal means located on an outer wall of the sleeve for sealing around the inner return port when the sleeve is in the closed position.

8. The subsea well assembly according to claim 4 wherein:

the inner and outer return ports extend radially relative to a longitudinal axis of the outer wellhead housing, with the inner return port having a radially inward inlet and a radially outward outlet;

wherein the sleeve is carried at the inlet of the return port; and wherein the sleeve has an axially extending passage that communicates with the inner return port when the sleeve is in the open position for cement returns to flow up the axially extending passage to the inner return port.

9. The subsea well assembly according to claim 4 wherein the engagement means comprises:

a latching profile formed on an inner side of the sleeve; and a latch ring mounted to a lower section of the casing hanger, the latch ring being resilient and biased outward for latching into the latching profile when the latch ring is moved downward adjacent to the sleeve, causing the sleeve to move downward with the casing hanger; and wherein the subsea well assembly further comprises:

a stop shoulder on the inner wellhead housing below the sleeve, the stop shoulder being positioned to limit the downward travel of the sleeve; and wherein the weight of the string of casing is supported by the latching profile, latch ring and stop shoulder.

10. In a subsea well assembly having a tubular outer wellhead housing secured to a string of conductor pipe extending into the well to a first depth, the outer wellhead housing having a radially extending outer return port extending therethrough, the improvement comprising in combination:

an inner wellhead housing which lands sealingly within the outer wellhead housing prior to the well being drilled past the first depth, the inner wellhead housing having a bore therethrough;

an inner return port extending radially through the inner wellhead housing in axial alignment with the outer return port, the inner return port having an inlet and an outlet;

a recess formed in a lower portion of the bore of the inner wellhead housing;

a sleeve slidably carried in the recess in the inner wellhead housing and being axially movable from a closed position to an open position, closing and opening the inner return port;

a latching profile formed on an inner side of the sleeve, the latching profile being substantially flush with the bore of the inner wellhead housing above the recess;

the sleeve when in the closed position allowing the well to be drilled to a second depth with drilling fluid returns flowing up the inner wellhead housing to a drilling platform;

a casing hanger secured to a string of casing, the casing hanger being lowered into and suspended in the inner wellhead housing after the well has been drilled to the second depth; and a latch ring mounted to a lower section of the casing hanger, the latch ring being resilient and biased outward for latching into the latching profile when the latch ring is moved downward adjacent to the sleeve, causing the sleeve to move downward with the casing hanger, moving the sleeve to the open position as the casing hanger is lowered into the inner wellhead housing, to allow cement returns to flow out the inner and outer return ports while cementing the string of casing in the well.

11. The subsea well assembly according to claim 10 wherein the sleeve has an axially extending passage that communicates with the inner return port when the sleeve is in the open position for cement returns to flow up the axially extending passage, out an upper end of the axially extending passage and into the inner return port.

12. The subsea well assembly according to claim 10 wherein the subsea well assembly further comprises:

a stop shoulder on the inner wellhead housing below the sleeve, the stop shoulder being positioned to limit the downward travel of the sleeve; and wherein the weight of the string of casing is supported by the latching profile, latch ring and stop shoulder.

13. The subsea well assembly according to claim 10 wherein the subsea well assembly further comprises:

a landing shoulder located in the bore of the inner wellhead housing above the recess; and a load bearing shoulder on the casing hanger which lands on the landing shoulder after the sleeve is in the open position for supporting the weight of the string of casing.

14. In a subsea well assembly having a tubular outer wellhead housing secured to a string of conductor pipe extending into the well to a first depth, the outer wellhead housing having a radially extending outer return port extending therethrough, the improvement comprising in combination:

an inner wellhead housing which lands sealingly within the outer wellhead housing, the inner wellhead housing having a bore therethrough;

an inner return port extending radially through the inner wellhead housing in axial alignment with the outer return port, the inner return port having an inlet and an outlet;

a recess formed in a lower portion of the bore of the inner wellhead housing;

a sleeve slidably carried in the recess in the inner wellhead housing and being axially movable from a closed position to an open position, closing and opening the inner return port;

an axially extending passage in the sleeve;

a latching profile formed on an inner side of the sleeve, the latching profile being substantially flush with the bore of the inner wellhead housing above the recess;

the sleeve when in the closed position allowing the well to be drilled to a second depth with drilling fluid returns flowing up the inner wellhead housing to a drilling platform;

a casing hanger secured to a string of casing, the casing hanger being lowered into and suspended in the inner wellhead housing after the well has been drilled to the second depth;

a latch ring mounted to a lower section of the casing hanger, the latch ring being resilient and biased outward for latching into the latching profile when the latch ring is moved downward adjacent to the sleeve, causing the sleeve to move downward with the casing hanger, moving the sleeve to the open position as the casing hanger is lowered into the inner wellhead housing, to allow cement returns to flow up through the axially extending passage and out the inner and outer return ports while cementing the string of casing in the well;

a stop shoulder on the inner wellhead housing below the sleeve, the stop shoulder being positioned to limit the downward travel of the sleeve; and wherein the weight of the string of casing is supported by the latching profile, latch ring and stop shoulder.

15. In a method of drilling a subsea well in which a tubular outer wellhead housing is secured to a string of conductor pipe and lowered into the well to a first depth, the improvement comprising:

lowering an inner wellhead housing into the outer wellhead housing prior to drilling the well past the first depth;

providing the inner wellhead housing with an inner return port which is in fluid communication with an outer return port formed in the outer wellhead housing;

closing the inner return port and drilling the well to a second depth, causing drilling fluid returns to flow up through the inner wellhead housing to a drilling platform; then securing a casing hanger to an upper end of the string of casing and lowering the string of casing into the well; and opening the inner return port, then cementing the string of casing, causing cement returns to flow out the inner and outer return ports.

16. The method according to claim 15, wherein the step of closing the inner return port comprises mounting a sleeve to the inner wellhead housing for axial movement from a closed to an open position.

17. The method according to claim 15, wherein:

the step of closing the inner return port comprises mounting a sleeve to the inner wellhead housing for axial movement from a closed to an open position; and the step of opening the inner return port comprises:

engaging the sleeve with a portion of the casing hanger to cause the sleeve to move downward as the casing hanger moves downward.

18. The method according to claim 15, wherein:

the step of closing the inner return port comprises mounting a sleeve to the inner wellhead housing for axial movement from a closed to an open position; and the step of opening the inner return port comprises:

engaging the sleeve with a portion of the casing hanger to cause the sleeve to move downward as the casing hanger moves downward; and wherein the method further comprises:

mounting a stop shoulder below the sleeve to limit the downward travel of the sleeve; and supporting the weight of the casing on the sleeve and stop shoulder.

19. The method according to claim 15, wherein:

the step of closing the inner return port comprises mounting a sleeve to the inner wellhead housing for axial movement from a closed to an open position; and the step of opening the inner return port comprises:

engaging the sleeve with a portion of the casing hanger to cause the sleeve to move downward as the casing hanger moves downward; and wherein the method further comprises:

providing a landing shoulder in the inner wellhead housing; and landing the casing hanger on the landing shoulder and supporting the weight of casing on the landing shoulder.

* * * * *

UNITED STATES PATENT AND TRADEMARK OFFICE

CERTIFICATE OF CORRECTION

PATENT NO. : 5,226,478

DATED : 7/13/93

INVENTOR(S) : Herman O. Henderson

It is certified that error appears in the above-indentified patent and that said Letters Patent is hereby corrected as shown below:

At column 1, line 55, the comma (2nd occurrence) should be deleted:

At column 3, line 9, "bore/25" should be--bore 25--;

At column 4, line 43, a period should follow "21";

At column 4, line 43, "while" should be--While--;

At column 6, line 8, a period should follow "diameter".

Signed and Sealed this

Twenty-ninth Day of March, 1994

Bruce Lehman

*Attest:*

BRUCE LEHMAN

*Attesting Officer*

*Commissioner of Patents and Trademarks*